US005464235A

United States Patent [19]

Goldman et al.

[11] Patent Number: 5,464,235

[45] Date of Patent: Nov. 7, 1995

[54] BRAKE LOCK FOR IN-LINE ROLLER SKATE BRAKING SYSTEM

[76] Inventors: David A. Goldman, 2321 Grove St., No. 2; Robert J. Dalton, 1077 Gilbert St., both of Boulder, Colo. 80302

[21] Appl. No.: 22,702

[22] Filed: Mar. 1, 1993

[51] Int. Cl.[6] ..... A63C 17/14

[52] U.S. Cl. ..... 280/11.2; 188/2 D; 74/502.2

[58] Field of Search ..... 280/11.2, 11.22, 280/11.23; 188/2 D, 24.18; 74/502.2, 501.5 R, 501.6; 56/11.3

[56] References Cited

U.S. PATENT DOCUMENTS

| | | | |
|---|---|---|---|
| 1,801,205 | 4/1931 | Mirick | 280/11.2 |
| 2,149,761 | 3/1939 | Coats | 188/24.18 X |
| 3,871,672 | 3/1975 | Bardy | 280/11.2 |
| 3,904,215 | 9/1975 | Bardy | 280/11.2 |
| 4,076,266 | 2/1978 | Krausz | 280/11.2 |
| 4,108,451 | 8/1978 | Scheck, Sr. | 280/11.2 |
| 4,300,781 | 11/1981 | Riggs | 280/11.2 |
| 4,312,514 | 1/1982 | Horowitz et al. | 280/11.2 |
| 4,644,816 | 2/1987 | Cockburn | 188/24.18 X |
| 4,785,683 | 11/1988 | Buckley et al. | 188/24.18 X |
| 4,943,075 | 7/1990 | Gates | 280/11.2 |
| 5,171,032 | 12/1992 | Dettmer | 280/11.22 X |
| 5,226,673 | 7/1993 | Cech | 280/11.2 |
| 5,239,941 | 8/1993 | Chibi | 74/502.2 |

*Primary Examiner*—Kenneth R. Rice
*Assistant Examiner*—Peter C. English
*Attorney, Agent, or Firm*—Francis A. Sirr; Earl C. Hancock

[57] ABSTRACT

The braking system for an in-line roller skate is operated by a cable attached to a trigger type of lever in a hand grip. This braking system is improved by incorporating an arrangement for allowing the skater to quickly attach or detach the end of the brake cable at the skate. Locking of the brakes to permit walking without rolling is obtained by incorporating a latch mechanism in the gripper handle. The gripper handle is storable by a snap-on type retainer for the belt or pocket of the user which permits the brake cable to move without unintentionally releasing the retainer from the person of the skater while avoiding kinking and twisting of the cable in response to the normal skating motions of the skater. Retention of the cable relative to the thigh of the user is realized by a belt or other attachment arrangement including a Velcro type of clip.

1 Claim, 7 Drawing Sheets

BRAKE LOCK FOR IN-LINE ROLLER SKATE BRAKING SYSTEM

BACKGROUND OF THE INVENTION

1. Field of the Invention

The present invention relates to in-line roller skates and to braking systems and methods useful in conjunction with in-line roller skates. More particularly, the present invention relates to improvements for in-line roller skates having brake elements associated with one or more wheels with manually operated levers mounted in a handle actuating such brakes. While the present invention is especially useful for manually-actuated brake systems for skates having the wheels thereof arranged in a line and sometimes referred to as roller blade skates, its application is not necessarily limited to those types of skates.

2. Description of the Prior Art

The use of the side slip motion of an ice skater to reduce, or stop, forward movement is not available to the in-line roller skater. Thus, the vast majority of the contemporary in-line roller skates include a rubber block extending from the rear and somewhat downwardly from the skate. This brake is obviously operable by only one skate at a time, and is extremely awkward to use especially at high speed. Because of the awkward nature of such brakes, in-line skaters frequently will use a sideways drag on the front wheel of one of the skates to reduce speed. This is likewise unsatisfactory, and only slightly better than no brakes at all.

Therefore, the prior art has given some attention to improving the braking of in-line skates. For instance, the use of foot and/or hand grip actuated brakes on in-line roller skates is known in the prior art. Typically, a cable extends from the hand grip to the brake mechanism which has a brake shoe movable to engage the periphery, side walls or inner brake drums of one or more wheels. Examples are shown in U.S. Pat. No. 3,871,672 by Bardy, U.S. Pat. No. 3,904,215 by Bardy, U.S. Pat. No. 4,076,266 by Krausz, U.S. Pat. No. 4,300,781 by Riggs, and U.S. Pat. No. 4,943,075 by Gates.

The roller skate or skateboard brake systems disclosed in the prior art use hand grips with cables which, from the perspective of the user, are permanently attached to the skate and are not detachable except through disassembly of awkward mechanisms often requiring the use of tools. Some examples are shown in U.S. Pat. No. 4,300,781 by Riggs and U.S. Pat. No. 4,076,266 by Krausz. The brake cables of both devices are awkward to remove and even potentially hazardous, as they tend to extend substantially from the rear of the skate or board.

Hand grip actuators on the end of the brake cable for prior art devices are sometimes attached to the pocket or belt of the user via clips, or the like, such as are suggested in Mirick U.S. Pat. No. 1,801,205, Bardy U.S. Pat. No. 3,904,215 and U.S. Pat. No. 4,108,451 by Scheck. Such attachments tend to kink the cable or to respond to the cable movements by unintentionally coming loose when the skater moves through the various stooping and bending motions associated with normal use of the skates.

The skater is sometimes faced with a circumstance where normal walking is imperative with the skate not allowed to roll. The skater can remove the skate, or skates, of course, but this is undesirable where only short-term walking is demanded. Thus, it was also recognized in the past that maintaining one or more brakes associated with roller skates in an actuated condition permits the skater to negotiate in at least an approximation of normal walking, as for climbing or descending stairs, passing over rocky or rough terrain, etc. For example, Horowitz et al U.S. Pat. No. 4,312,514 employs a thumb screw to manually tighten brake pads into a locked condition for this purpose.

U.S. Pat. Nos. 3,871,672 and 3,904,215, both by Bardy, include somewhat complex mechanisms to allow sequential locking and unlocking of roller skate brakes either by ankle motion with respect to linked levers, or by hand actuated cables or cords. Both patents employ an array of magnets, springs and levers to produce the foregoing result in configurations entirely unsuited for the typical operating environment of skates. In fact, the brakes of these prior art systems will tend to lock and remain locked even when the user intends no such result.

The flailing of the cable interconnecting the hand grip and the skate brake structures is a safety hazard for the typical skater which remains unresolved in the prior art devices. Furthermore, the prior art devices did not allow the skater to skate with free hands by temporarily storing the hand grip on the person of the skater in a manner that accommodates the cable movement from normal skating motions, while concurrently remaining handy for rapid retrieval when needed.

The present invention is adaptable for use with practically any type of in-line brake configuration, but is particularly well suited for use in conjunction with in-line skate braking structure disclosed in U.S. patent application Ser. No. 07/753,318 filed Aug. 30, 1991 by Donald E. Cech, issued as U.S. Pat. No. 5,226,673 on Jul. 13, 1993; and in application Ser. No. 07/950,082 filed Sep. 23, 1992 by Donald E. Cech.

DISCLOSURE OF THE INVENTION

This invention is a brake system for in-line skates which includes improvements that significantly enhance the convenience and safety of such skates. One of the primary features in accordance with this invention is in the inclusion of a relatively simple, but reliable, attach/detach mechanism to allow the user to disconnect the cables and the hand grips from the skate so that the skates are essentially free wheeling as they are with the contemporary skates. An advantageous result of the brake disconnect structure of this invention is that it is attachable as a retrofit to an existing in-line skate, and is well suited for inclusion as an element of a product from an original equipment manufacturer. Furthermore, the present invention enjoys the advantage of adding little or no parts extending from the skate itself, as compared to an in-line skate with no brakes at all.

A second and equally important feature is in the inclusion of a means for locking the brakes in the wheel engaging position to allow the user to walk on the skates, such as up and down stairs, etc.

Yet a third feature resides is in the temporary storage of the hand grip for the skate brake system for quick, but convenient and safe, retrieval by the skater. This feature includes the pivotable attachment of the manually operable hand grip to the waist of the user in a manner that accommodates the movement of the grip in a plane generally parallel to the side of the skater, but not in a direction normal to such a plane.

An additional feature of the present invention resides in devices and steps for controlling the brake cable so as to maintain it as close to the person of the skater as possible, thereby reducing the risk of snagging of the brake cable so as to hazard injury to the skater or to others.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
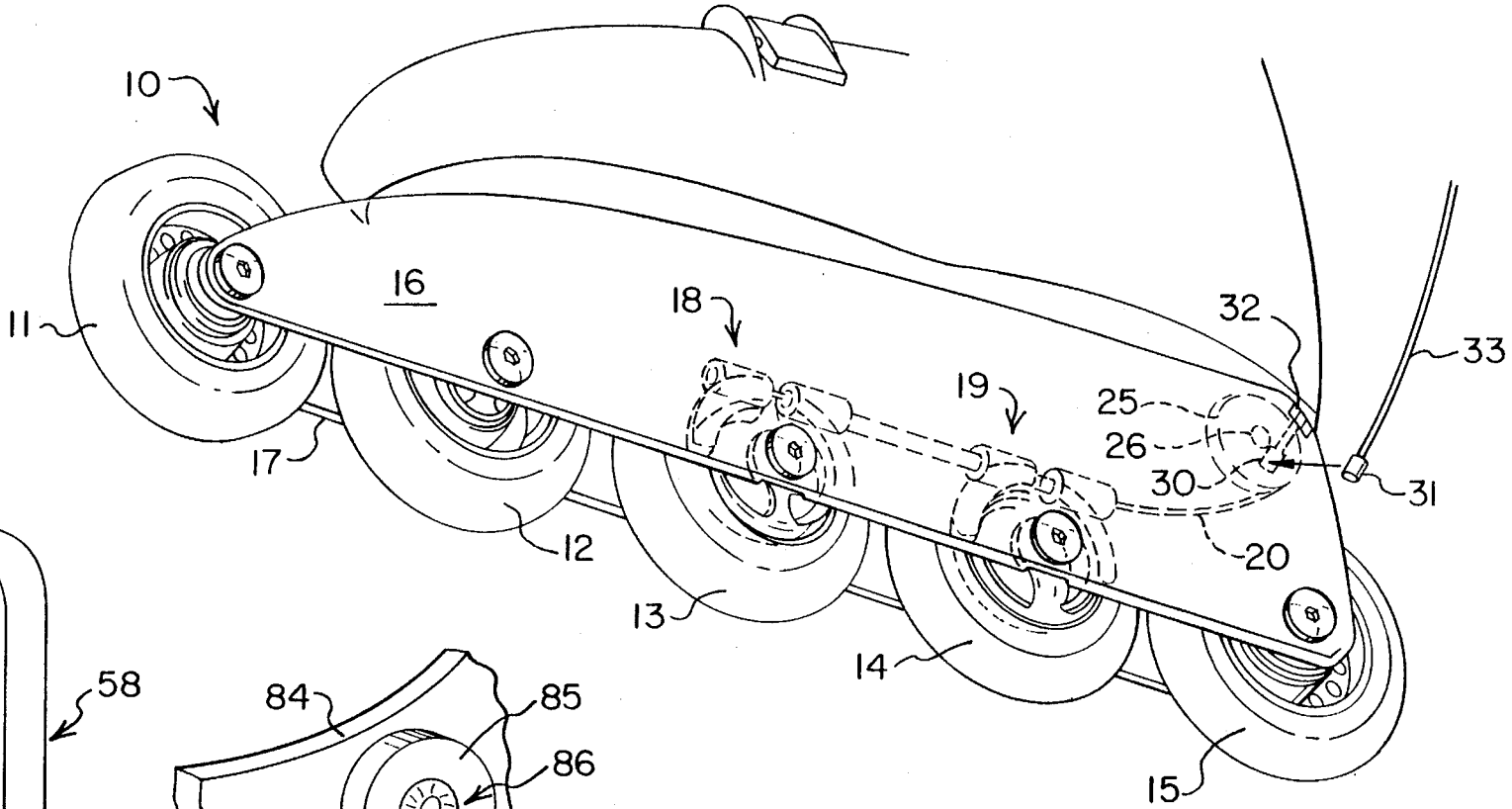
FIG. 1 is an isometric view from below of an embodiment of an in-line roller skate incorporating a quick release brake cable attachment.

The quick disconnect feature of this invention is shown in FIG. 1 wherein in-line skate 10 has five wheels 11–15 rotatably mounted on axles extending between side frames 16 and 17. While five wheels are shown in this exemplary embodiment, the various features of this invention are readily adapted for use with roller skates or skateboards having any number of wheels. The particular type of brakes for wheels 13 and 14, as shown in the FIG. 1 example, are caliper-type brake assemblies 18 and 19, respectively, associated therewith. These brake assemblies in this embodiment are manually actuated and provide braking in response to movement of cable 20 by gripping a circular drum on the respective wheel.

At the right end of the wheel mounting brackets is a disc-like hub 25 which is pivotally mounted on axle 26. A groove 30 is cut into disc 25 along the side as shown, or into the periphery of disc 25. In either event, groove 30 is in a configuration to accept the nib on end 31 of the coaxially moveable inner filament within cable 33, which terminates at its other end in a hand gripper device (not shown in FIG. 1). A clip 32 securely receives the outer sleeve of cable 33 so as to allow translation of the cable filament movement into rotary movement of hub 25 upon manual actuation and release of the lever in the hand grip.

Enough space is allowed between the inner face of frame 16 and disc 25 to permit the user to insert, or remove, cable end 31 relative to groove 30, although it is possible to externally mount the retainer clip 32. Cable end 31 is retained within groove 30 by a snap-in configuration, or by other retaining means. Once in groove 30, an upward force on the filament of cable 33 causes hub 25 to rotate and apply a force to cable 20, thereby braking skate 10 by causing caliper assemblies 18 and 19 to close. Braking results as the brake bands frictionally engage drums on wheels 13 and 14.

Figure 2:
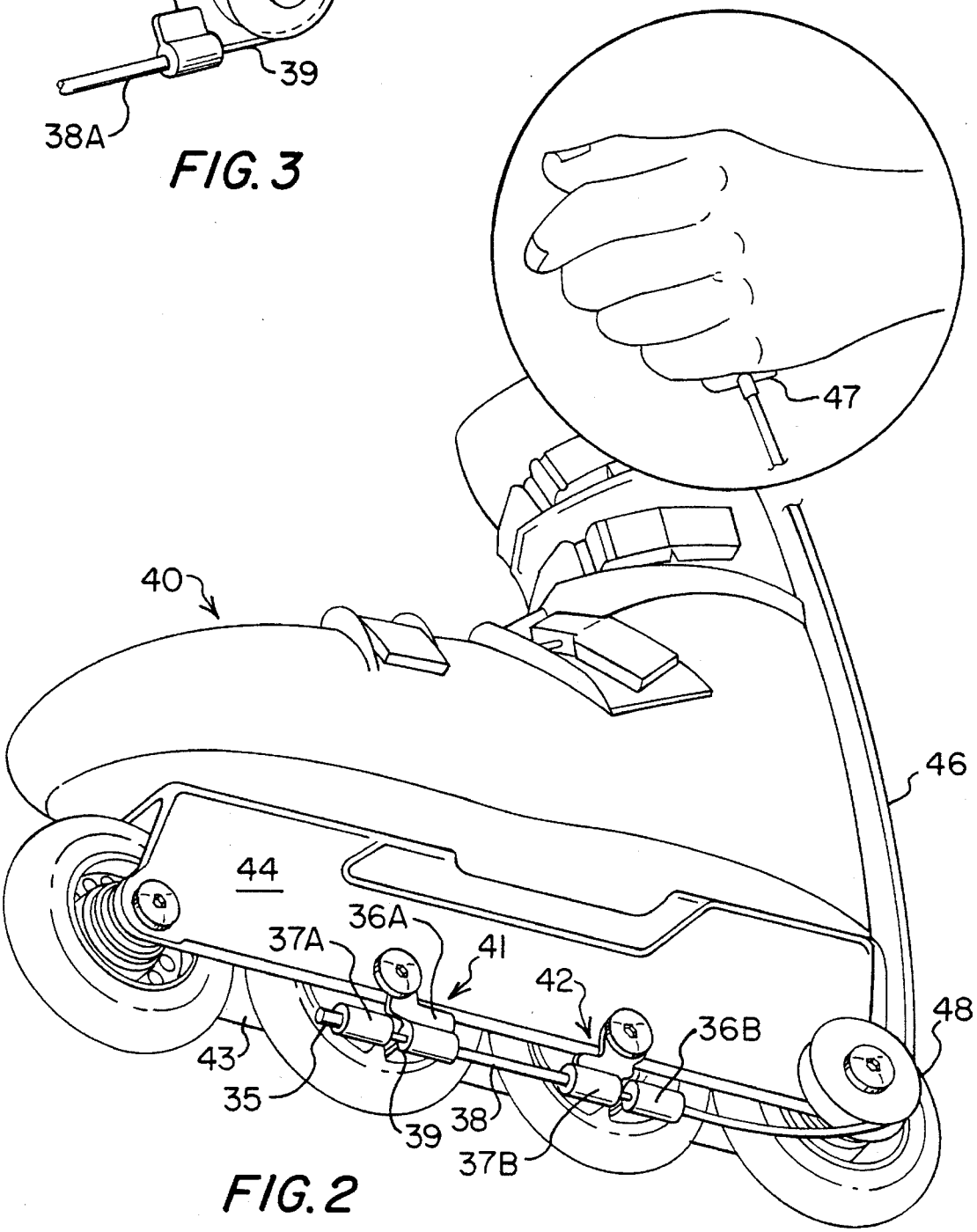
FIG. 2 is another lower isometric view of an embodiment of an in-line roller skate, including another form of structure directly coupled to brake hangers for easily attaching and detaching a brake cable.

An alternative cable coupling arrangement is shown for skate 40 in FIG. 2 wherein the brake cable 46 is more directly but releasably coupled to the caliper brake elements. In FIG. 2, hanger assemblies 41 and 42 for the caliper type brakes are externally mounted relative to frame member 44. The actuator cable 39, contained within sheath 46, extends to hand grip 47. Cable 39 and its protective sheath 46 are attached to the perimeter of hub 48 as by a snap-in edge groove or the like.

Brake hanger assemblies 41 and 42 are activated by coaxially moveable cable filament 39 which passes through protective outer casing 38, and freely passes through hanger 36A which is fixed relative to frame 44. The inner filament 39 of cable 46 passes through retainer 37A and is terminated by cap 35. Retainer 37A is part of the free end of the calipers for brake assembly 41. Free end 36B for the other brake assembly 42 is secured to the outer protective sleeve of cable 46 so that pressure on the actuator lever at grip 47 results in a closure force between elements 36B and 37A, thereby squeezing the brakes on for both brake assemblies 41 and 42. That is, squeezing on the hand grip 47 results in the application of tension to inner cable 39 causing hanger 37A to move towards hanger element 36A. The brake pads for the wheels engage the brake drums of those wheels so as to apply braking to skate 40.

The cable 46 is detached from skate 40 by removing cap 35 and pulling cable 46 out of hanger 36B which results in pulling inner filament 39 through hanger elements 36 and 37, as well as through sleeve 38. Pulling of cable 46 from the periphery of hub 48 effects complete freedom of cable 46.

The brake assemblies of FIG. 1 operate in a manner similar to FIG. 2, except the hangers are appropriately attached inside the frame members 16 and 17. One end of the brake band caliper is fixed relative to mounting frames 16 and 17, while the other end is attached to the actuator cable 20 so that tension applied to cable 20 clamps the brake band element around a brake drum associated with the central hub of wheels 13 and 14.

Figure 3:
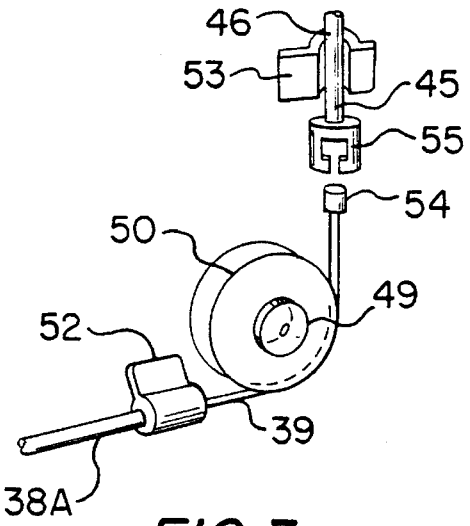
FIG. 3 is yet another arrangement for manually attaching a brake cable segment between a hand grip and a brake cable segment on an in-line skate.

FIG. 3 illustrates the addition of a quick disconnect to skate 40. A disk 50 is rotatably mounted on axle 49 with a hanger 52 retaining one end of a cable segment which includes outer sheath 38A. Outer sheath 38A is thus held in fixed relation to the skate wheel mounting frames, while the inner cable filament 39 is attached to the perimeter of disk or hub 50. The other end of sheath 38A is secured into hanger 36B. The amount of travel of cable filament 39 between the full-on and full-off states is relatively small, so that retention of cable 39 to the perimeter of disk 50 at a single point half way around the lower right quadrant of disk 50 should normally suffice. Cable 39 ends in a nub 54 for connecting to receiver 55 on the end of the actuator cable filament 45 within protective sheath 46 of the upper cable segment. Connector 55 is configured with a snap-in notch for receiving nub 54. A clip type hanger 53 is fixed relative to the wheel mounting frames, and receives the end of the protective sleeve 46 for the upper cable segment.

Note that it is possible to employ a groove similar to 30, as shown in FIG. 1, (or other retaining means) within disk 50 to receive the lower end of the cable 45, if desired. Regardless, the attached cable functions the same in applying the brakes, but is easily detachable so as to allow the skate to free wheel in the same way the preponderance of the contemporary skates are used. Still further, the cable detaching is quickly accomplished manually without the need for tools, such as pliers, wrenches, screw drivers or the like.

The present invention contemplates inclusion of an easily operated structure to reliably retain the skate brake cable in the actuated position so as to lock the skate wheels in place with actuation, and release of the lock occurring in response to manual commands by the skate user. This allows the wearer to traverse terrain wherein rolling of the wheels is undesirable, or hazardous, such as in negotiating up and down steps, etc. While addition of a locking mechanism at the skate itself is possible to lock the wheels, the presently preferred implementation of the invention is associated with the hand grip, and will only actuate, or release, the locking function in response to positive action taken by the skater.

Figure 4:
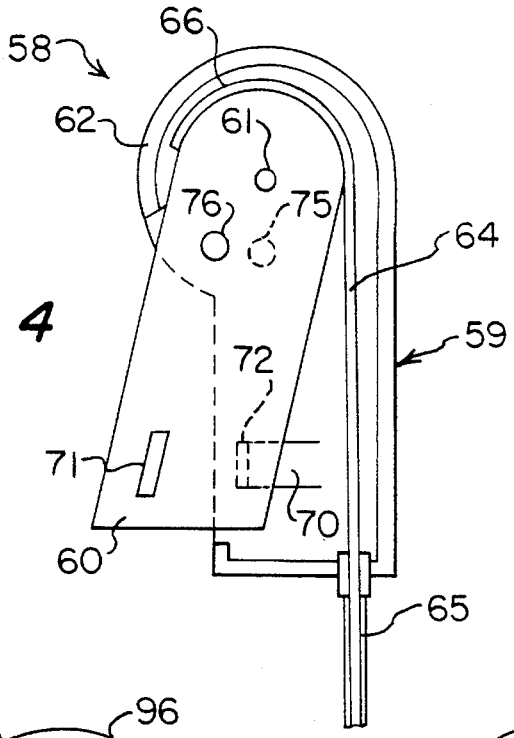
FIG. 4 is a partially sectioned elevation view of a manually operated brake actuator for an in-line roller skate including two different structures for locking the brake cable with the brake applied to the skate wheels.

FIG. 4 shows a sectioned view of hand grip 58 with the upper side of housing 59 removed. A trigger-like member 60 pivots around pin 61 within housing 59 between the lower shell 62 and its complementary upper shell which is not shown in FIG. 4. A spring (not shown) biases trigger 60 outwardly. Cable 64 extends from ultimate attachment to the brake assemblies (such as is shown in FIGS. 1, 2 and 3) within a protective sheath 65, and is secured to the upper perimeter 66 of trigger 60. Thus, squeezing of trigger 60 into housing 59 results in the application of tension to cable 64, thereby applying the brakes to the skate wheels. The structure thus far described is conventional.

Preferably, hand grip 58 includes some means selectably actuable for retaining cable 64 in its tensioned state. Two variations of this are shown in FIG. 4. One form is to incorporate a living hinge type of arm 70, in the body of housing 59, with arm 70 having an inwardly protruding ridge 72 transversely oriented across its free end. A slot 71 is formed into the trigger 60 for receiving ridge 72 on the end of the living hinge arm 70 if the user presses it inwardly after squeezing trigger 60. Trigger 60 is thus held in the latched position because of the outward spring biasing on trigger 60 until the user pulls inwardly on trigger 60, thereby releasing hinge arm 70 to spring outwardly and withdraw ridge 72 from slot 71.

An alternate latching mechanism is shown including a plunger located roughly at 75 in FIG. 4, but on the upper shell of housing 59. Trigger 60 has a mating hole 76 therein so that squeezing trigger 60 until hole 76 is beneath plunger 75 allows the user to depress plunger 75 into hole 76. The spring biasing outwardly on trigger 60 causes pin 75 to lock within hole 76 upon release of trigger 60 in the cable 64 tensioned position. A slight pull on trigger 60 releases plunger 75, which withdraws from bore 76 because pin 75 is outwardly biased by a spring (not shown). Probably the grip 58 will incorporate only one locking mechanism, but there is a range of suitable locations for it on handle 58. Again, the key to this feature is to include some arrangement for selectively and releasably retaining the brake cable in its tensioned state in a manner that allows fingertip control by the skater.

Figure 6:
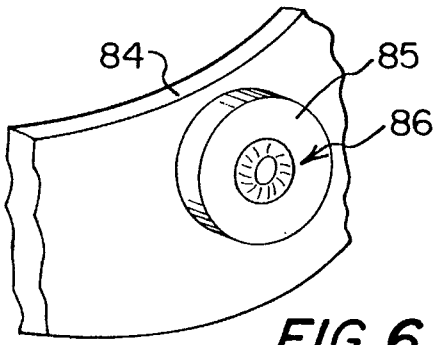
FIG. 6 is a partially broken view of a belt adapter for pivotably receiving a FIG. 5 type of brake grip.
Figure 5:
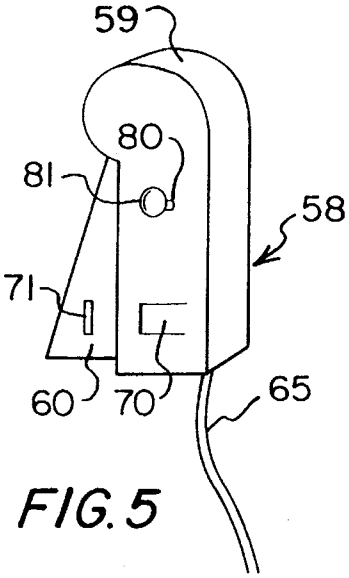
FIG. 5 is an isometric view of the FIG. 4 type of manual brake grip.

The skate user may sometimes prefer to skate hands-free without using the brakes, but with the grips readily available. A conventional clip on the belt or pocket is not reliable for the skater, however, as the stresses applied by the cable to the clip, as a result of the normal skating maneuvers by the user, frequently causes the clip to escape so that the grips fall to the ground. Easy release of the handle grip while the skater is in motion is likewise important. A feature of this invention that resolves the problems while allowing dynamic storage and retrieval of the handle grip is shown in FIGS. 5 and 6.

That is, previous attempts to clip the grip to the belt at the waist of the user have failed because the cable 65 twists so as either to detach the grip from the belt or pocket of the user, or to cause the cable to kink or foul. As seen in FIG. 5, housing 59 of hand grip 58 has a stub composed of post 80 and ball or mushroom shaped element 81 extending outwardly therefrom. Note that ball 81 can take the form of a conventional flexible plastic stub having its periphery formed of a series of spring-like fingers which squeeze into a temporarily smaller diameter as they pass through a small bore, but which snap back into their original size after passing through that bore. In FIG. 6, belt 84 worn by the user has an attachment 85, including a flexible bore 86 configured to receive in snap-in fashion the ball 81 on post 80 on housing 59 in FIG. 5.

Thus, hand grip 58 is free to pivot about post 80 when snapped into receiver 85, thereby preventing kinking or fouling of the cable 65, as well as avoiding disconnection between belt 84 and hand grip 58. This allows the user to skate freely without having to hold the grip 58, but with grip 58 handy for the user to remove grip 58 from bore 86 even while the skater is in motion. This attachment furthermore allows the user to actuate the brakes via grip 58 without removing it from attachment 85 if a sudden emergency is encountered. Note that this handle storage feature is advantageously useful for the user upon disconnecting cable 65, as by one of the disconnect mechanisms herein described, for instance, since it accommodates storage of the disconnected grip 58 and its cable 65.

Figure 7:
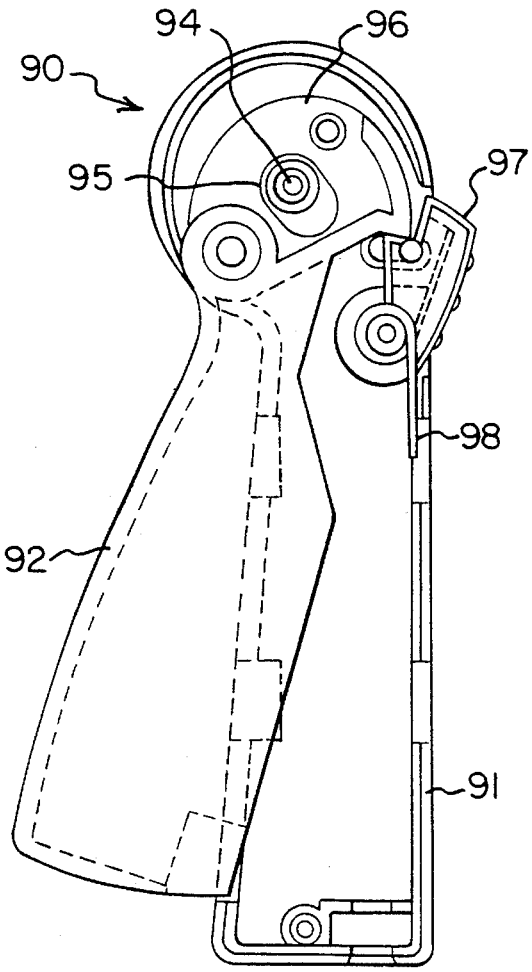
FIG. 7 is a sectioned plan view of a manually operated brake grip employing another embodiment of a brake locking mechanism.
Figure 8:
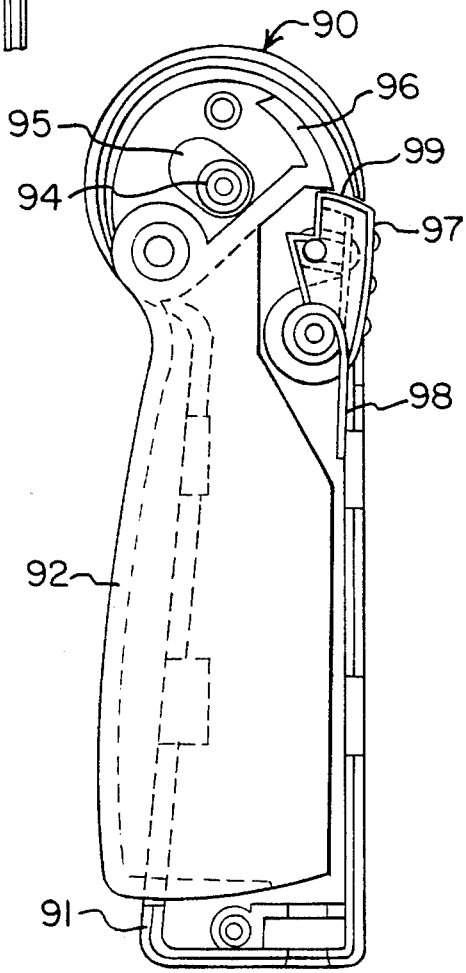
FIG. 8 is a handle grip in accordance with FIG. 7 showing the parts relationships when the brake is set and locked.

Another configuration for locking the skate brakes at handle grip 90 is shown in FIGS. 7 and 8. Housing 91 has trigger 92 pivotably retained therein via shaft 94 and eccentric bore 95 within the curved upper head 96. Trigger 92 is spring biased outwardly from housing 91 by means not shown, so as to normally assume the position shown in FIG. 7. The brake actuator cable (also not shown) is attached to curved head 96, and operates in a manner similar to FIG. 4. A thumb latch 97 is pivotably attached to housing 91, and is normally biased by spring 98 into the released position shown in FIG. 7.

The skate brakes function by the user squeezing and releasing trigger 92 with respect to housing 91. When it is desired to lock the skate brakes in the actuated position, the user squeezes trigger 92 into housing 91, and then depresses thumb latch 97 followed by release of trigger 92. Curved head 96 engages upper surface 99 of latch 97, as seen in FIG. 8, thereby locking the brakes on. The lock is easily released simply by again squeezing and releasing trigger 92 without holding latch 97 down.

Figure 9:
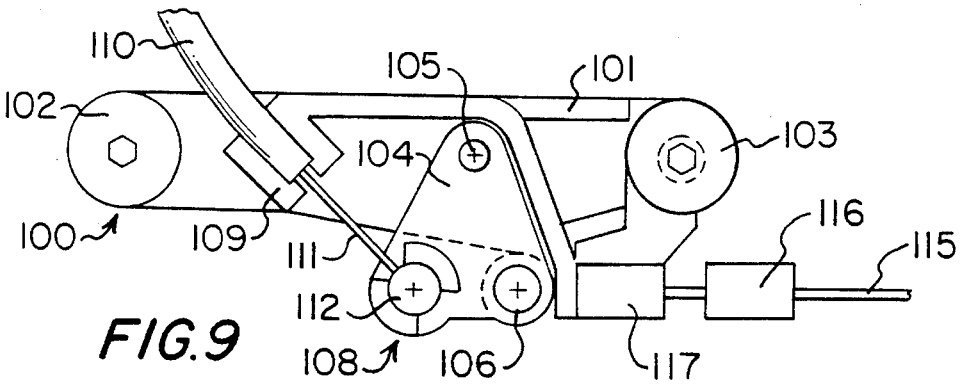
FIG. 9 is a plan view of another embodiment for manually attaching and detaching a brake cable with respect to an in-line roller skate.
Figure 10:
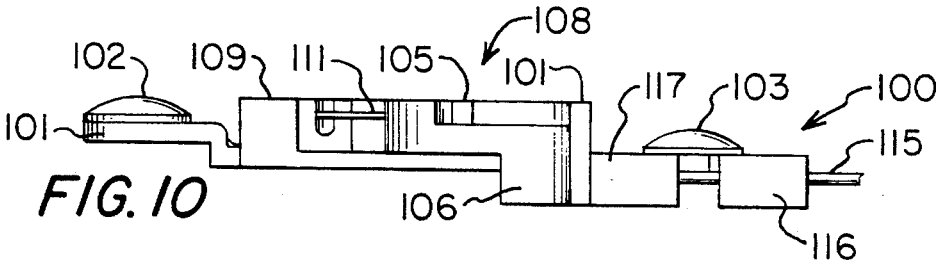
FIG. 10 is a bottom view of the FIG. 9 embodiment.

A particularly attractive quick release type of brake cable attachment arrangement is illustrated in the assembly 100 of FIGS. 9 and 10. FIG. 10 is a bottom view of the FIG. 9 assembly 100. Frame 101 is attached to the skate wheel mounting frame as by bolts, or screws, 102 and 103. Rocker arm 104 is rotatably mounted on shaft 105, and has a stub 106 and receiver cup 108 along its edge in space relation from shaft 105. Housing 101 includes elements extending therefrom to form a clip 109.

The brake actuator cable includes protective sleeve 110 which coaxially contains actuator cable 111 with a ball 112 secured to the end of actuator cable 111. Ball 112 is configured to snap into receiving cup 108 on rocker arm 104. A separate cable 115 freely passes through the hollow sleeve portion of the relatively fixed brake caliper hanger 117. Cable 115 is secured to both collar 116 attached to the free end of the caliper brake arm, and to stub 106 of rocker arm 104. Cable 115 can extend to the right, as seen in FIG. 9, through additional fixed hangers similar to 117 with attachment to the associated brake caliper free end collars similar to 116 thereby establishing a braking function relative to a plurality of wheels.

In use, the skater attaches cable 110 to the skate by first snapping ball 112 into cup 108, followed by snapping the end of sleeve 110 into retaining clip 109. Closure of the trigger within the grip handle on the other end of sleeve 110 and cable 111 results in pivoting arm 104 clockwise, as seen in FIG. 9. This pivots stub 106 to the left in FIG. 9 to apply tension to cable 115 causing collar 116 and sleeve 117 to close squeezing the brake band against the brake drum of the associated wheel. Springs in the brake caliper assembly will apply an opening force to the brake band elements of the caliper so that the components of FIG. 9 will return to the configuration shown when the trigger of the grip handle is released. Detaching of sleeve 110 and cable 111 is easily accomplished by merely pulling them out of the clip 109 and cup 108, respectively.

Figure 11:
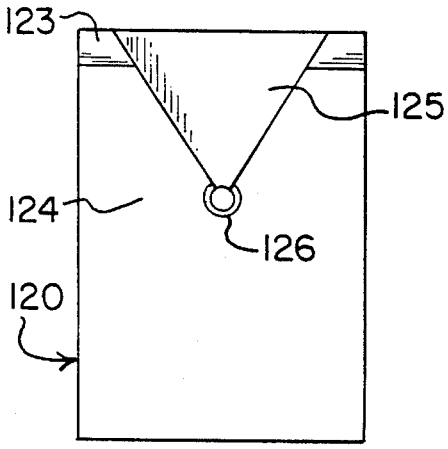
FIG. 11 is a front view of a belt clip adapted to receive and temporarily store a brake grip.
Figure 12:
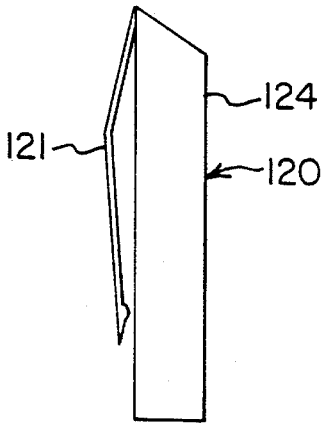
FIG. 12 is a side view of the FIG. 11 belt clip.
Figure 13:
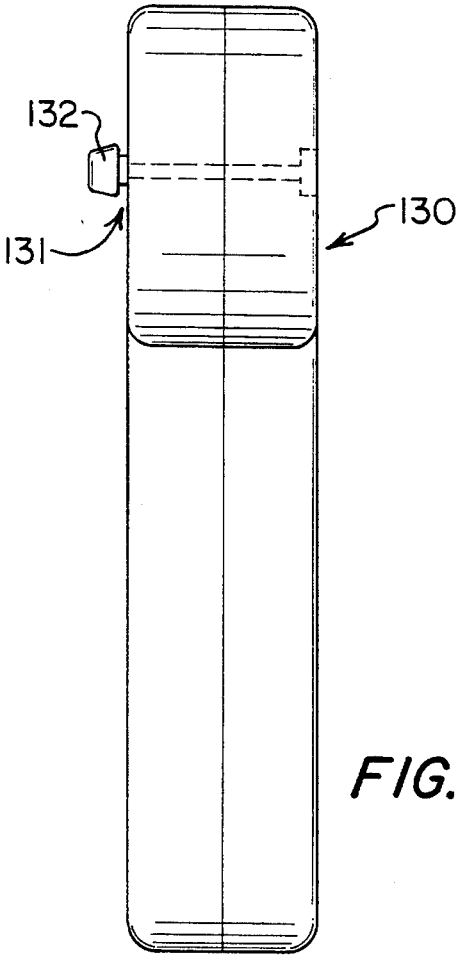
FIG. 13 is a side view of a manual brake grip including a stub for cooperating with the FIGS. 11 and 12 type of belt clip.

A belt clip, which enjoys the pivoting advantage of the attachment shown in FIGS. 5 and 6, is presented by FIGS. 11, 12 and 13. Clip 120 is constructed of a somewhat hollow box-like configuration with a spring element 121 extending downwardly from its rear, as seen in FIG. 12. The top 123 and front face 124 have a generally V-shaped groove 125 extending downwardly, as shown in FIG. 11, terminating in a ring-like central opening 126. Note that a suitable clip is possible by having simply two elements, namely, the rear spring arm similar to 121, and a relatively shallow front bent therefrom similar to front face 124, including its V-shaped receiver or equivalent. Note further, that the receiver clip can take configurations suitable for orienting the opening of the V-shaped groove in forward, rearward and downward relation to the skater instead of the upward facing orientation as shown in FIG. 11.

The grip handle 130 of FIG. 13 cooperates with the receiver clip 120 via bulbous end 132 on shaft 131. Thus the skater who wishes to store the grip handle 130 without looking, and even while skating, can position the handle 130 over the clip 120 and simply move it downwardly. The V-groove 125 will guide shaft 131 so that it snaps into central aperture 126, thereby retaining it while allowing grip handle 130 to pivot in accommodation of the cable gyrations. Removal of grip 130 is likewise a simple matter of lifting the handle relative to receiver 120 which is also possible without looking while the skater is in motion.

Figure 14:
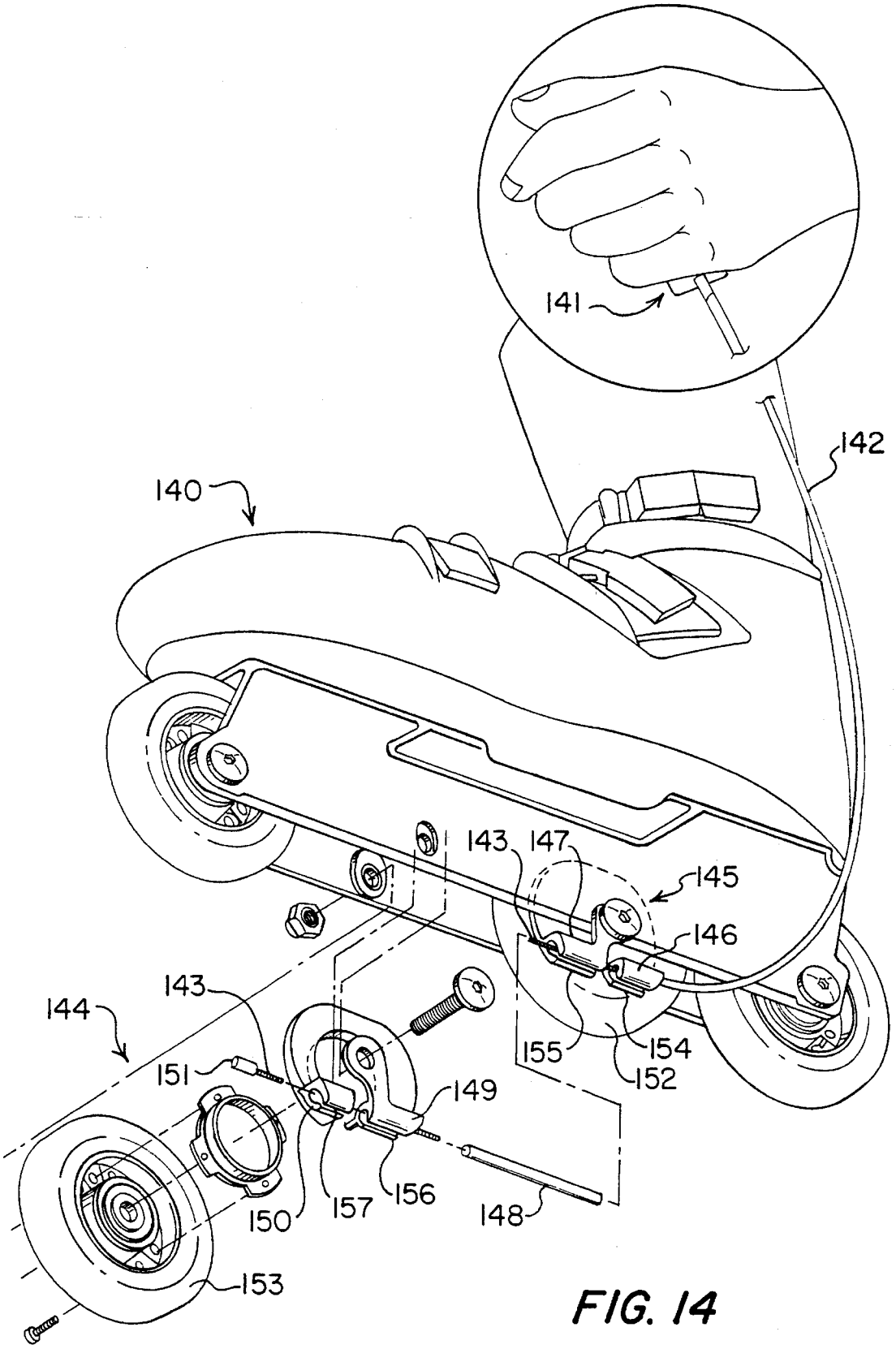
FIG. 14 is a partially exploded view of another embodiment of a quick disconnect system for the brake cable for an in-line roller skate.

Another embodiment of a quick release system for an in-line roller skate brake cable is presented in FIG. 14 for skate 140. Hand grip 141 is connected to cable 142, as described previously herein, and cable 142 contains internal filament element 143 for transmitting the brake applying force from the grip to caliper type brake assemblies 144 and 145 also generally as described above. Brake assembly 144 is shown in a somewhat exploded view in FIG. 14. Hanger 146 is attached to the free end of the caliper brake assembly 145. In addition, it is secured to the outer protective cover of cable 142, but allows coaxial filament 143 to freely move therethrough.

From hanger 146, internal cable element 143 freely passes through hanger 147 attached to the fixed end of the caliper brake assembly 145, as shown, and then is threaded through tube 148 before passing through fixed end hanger 149 and free end hanger 150 of caliper brake assembly 144. While tube 148 may provide some additional stability by preventing hangers 147 and 149 from pivoting towards one another, the primary function of tube 148 is to protect the coaxial filament element 143 as it passes between assemblies 144 and 145. The distal end of the coaxial cable filament 143 has a cap 151 securely attached thereto. The size of cap 151 is such that it cannot pass through the central bore of hanger 150.

Accordingly, squeezing of the trigger element in hand grip 141 by the skater results in application of closure forces between hangers 146 and 150, thereby causing the hangers 149 and 150, as well as hangers 146 and 147 of respective brake assemblies 144 and 145, to move toward one another. The brake pads of assemblies 144 and 145 engage their respective drums so as to apply braking forces to wheels 152 and 153.

Note that hangers 146, 147, 149, and 150 have respective narrow slots 154-157 along the lower edges thereof. These slots each open into the central bore through their associated hanger elements wherein these central bores are of an adequate size to allow filament 143 to move freely therein. However, by fabricating hangers 146, 147, 149, and 150 of somewhat flexible plastic material and configuring slots 154–157 somewhat smaller than the diameter of filament 143, the user can apply or remove the brake actuator cable relative to skate 140 by snapping cable 143 through each of slots 154–157 with tube 148 positioned between the assemblies 144 and 145.

That is, cable 142 has tube 148 and end cap 151 as permanent parts of the cable assembly itself which is attached and removed from skate 140 as a unit. In use, attachment of the brake cable 142 is accomplished by passing filament cable 143 through each of the slots 154–157, with tube 148 and cap 151 in position as shown. The outer sleeve of cable 142 is forced into the central bore of hanger 146. The brake system is thus ready for for use, and removal of the cable unit is achieved by simply reversing those steps.

Figure 15:
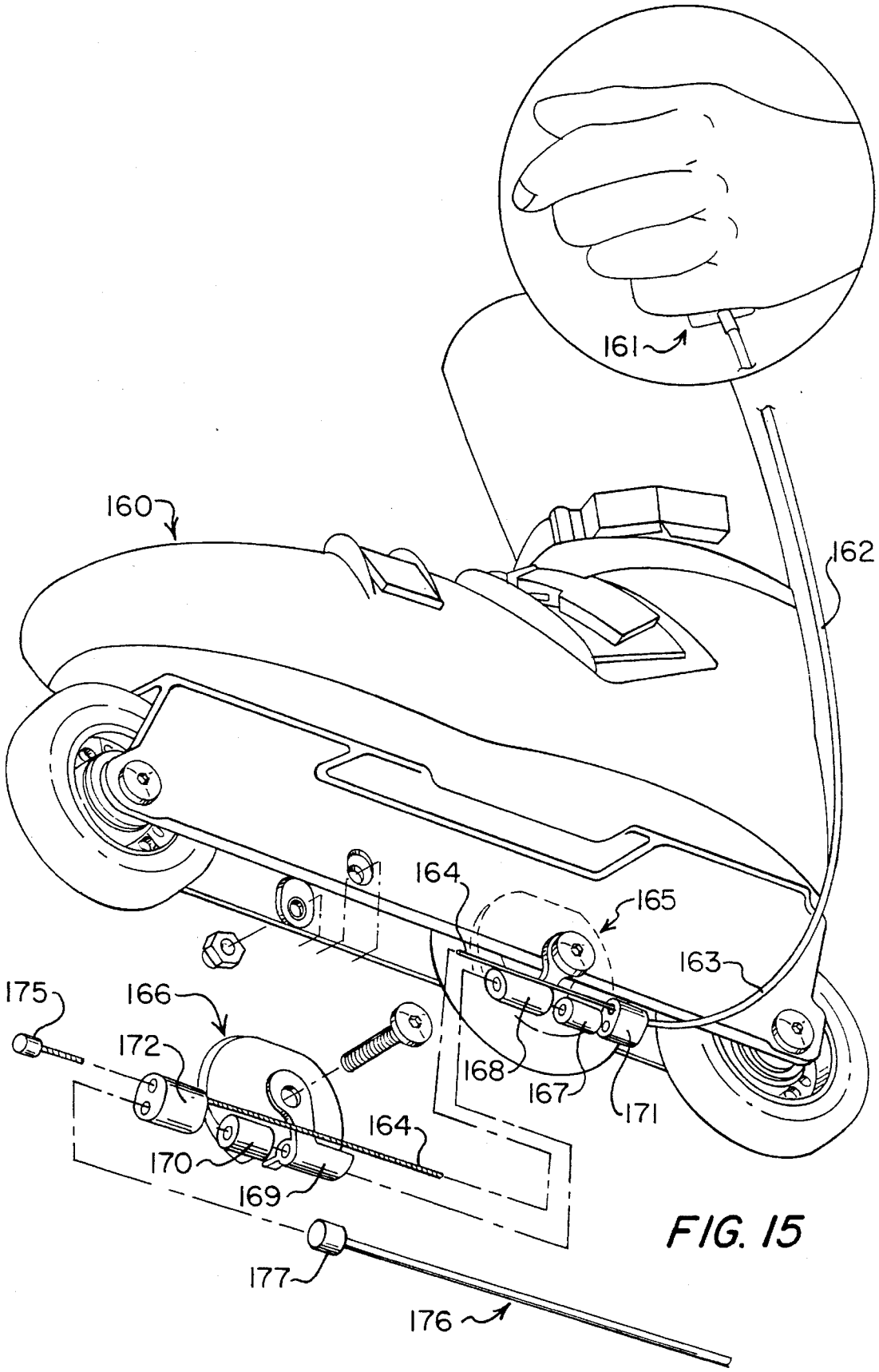
FIG. 15 is a partially exploded view of yet another embodiment of a quick disconnect for the brake cable employed in an in-line roller skate.

Another embodiment of an arrangement for permitting quick disconnect of an in-line skate brake control cable from skate 160 is shown in somewhat exploded view in FIG. 15.

Again, hand grip 161 functions generally along the lines of its counterparts described previously herein, and cable 162 is formed of an outer protective sleeve 163 and inner coaxially moveable filament cable 164. Caliper type brake assemblies 165 and 166 are again configured to control the two inner wheels, the leftmost of which is omitted in FIG. 15 for clarity. It is structurally similar to wheel 153 and its associated brake elements in FIG. 14.

Brake assembly 165 includes a collar 167 attached to its free end, and collar 168 attached to its end which is fixed relative to the wheel mounting frame. Similarly, assembly 166 includes a collar 169 attached to its fixed end of the caliper, and collar 170 attached to its free end. All of collars 167-170 have a central bore therethrough. Cable 162 is connected to receiving block 171, and filament 164 passes therefrom through the upper hole of block 172 with its distal end having cap 175 secured thereto.

Thus, the lower end of cable 162 has a releasable unit thereon, including blocks 171 and 172, as well as filament cable 164 and cap 175. This unit is attached and released by an elongated pin 176. The skater effects this attachment by aligning the lower bores of blocks 171 and 172 with the openings through hangers 167–170 so that pin 176 is forced through all of those bores, thus retaining cable 162 in position on skate 160.

Figure 16:
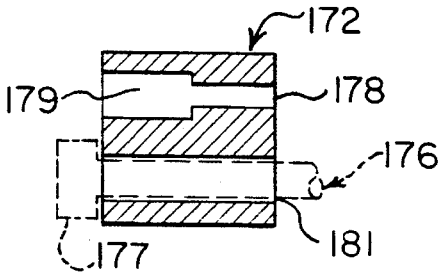
FIG. 16 is a sectioned plan view of the front hanger element of the FIG. 15 brake disconnect structure.
Figure 17:
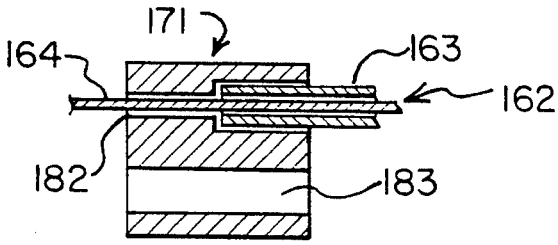
FIG. 17 is a sectioned plan view of the rear hanger element of the FIG. 15 brake disconnect system.

FIGS. 16 and 17 are somewhat enlarged and sectioned views of receiving blocks 172 and 171, respectively. The upper bore 178 of block 172 has an internal shoulder so as to define a chamber 179 for receiving cap 175 (note FIG. 15). The lower bore 181 is relatively smooth, and preferably receives pin 176 snugly with its head 177 oriented as indicated in phantom in FIG. 16. Block 171 likewise has an internal shoulder defined for upper bore 182 but, in this case, for the purpose of allowing filament cable 164 to freely pass in coaxial relation therethrough, while snugly retaining the outer protective sleeve 163 of cable 162. The lower bore 183 is configured to snugly receive the distal end of pin 176 (not shown in FIG. 17). It is possible to include means for preventing pin from escaping such as by a cotter pin, C-spring or the like, but, in practice, it was found that the sequential collar bores were adequate to retain pin 176 in place without such additional locking elements.

Filament cable 164 thus passes directly from block 171 to block 172 as shown. Application of brake pressure on the trigger in grip 161 results in application of a closure force, as between blocks 171 and 172. This causes pressure on hanger 170 towards fixed hanger 169 for assembly 166 at the same time that pressure is applied to free-end hanger 167 towards fixed hanger 168. Both inner wheels of skate 160 have their brakes applied as a consequence of these forces. The attachment unit is comprised of blocks 171 and 172 having filament cable 164 secured therebetween via cap 175. Pin 176 is manually inserted, or removed, to secure or release this attachment unit relative to skate 160.

Figure 18:
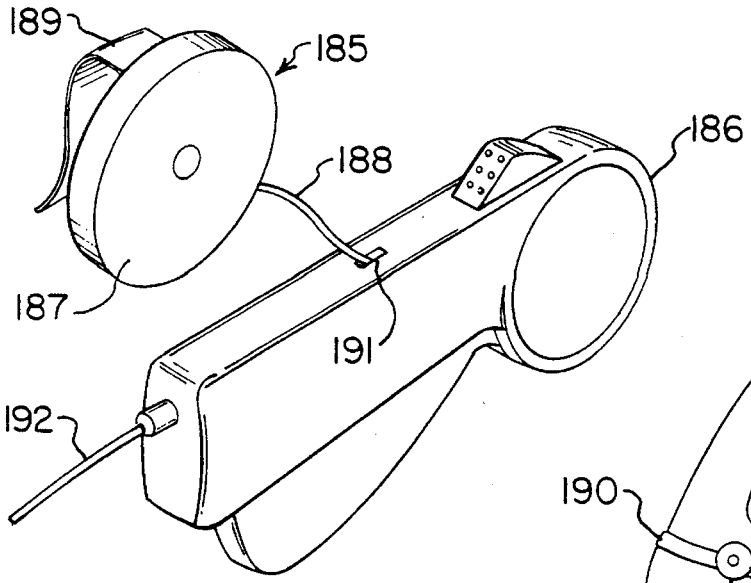
FIG. 18 is a view of a device for tethering a hand grip to the person of a skater.

FIG. 18 is a tethering arrangement 185 for retaining hand grip 186 to the skater in a convenient but secure manner. The grip 186 functions, as described above, as far as applying, locking and/or releasing the skate brakes is concerned. However, housing 187 has a tape or cord 188 extending therefrom, which terminates in pivotable attachment 191 on the body of grip 186. A clip 189 on the rear of housing 187 allows the skater to temporarily attach housing 197 to the person of the skater, such as by clipping on belt 190 shown in FIG. 19. Cord 188 is spring biased so as to return grip 186 into proximity to housing 187 and, thus, the waist of the skater whenever the skater lets go of grip 186.

Cable 192 interconnects the grip 186 with a skate (not shown in FIG. 19) as described above. When the skater desires to skate freely, mere dropping of the grip 186 results in its automatic return to the waist of the skater where the pivotable connection 191 allows it to accommodate the flexing of the cable 192, while retaining grip 186 in an extremely handy position for the skater. The tethering arrangement 185 minimizes the amount of attention the skater must give to storage and retrieval of grip 186.

Figure 19:
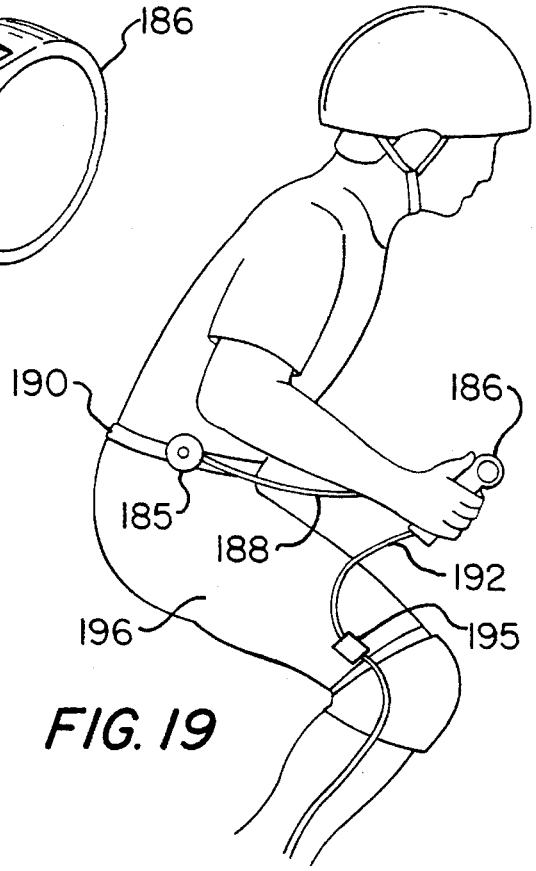
FIG. 19 illustrates use of the FIG. 18 tethering device and additionally shows a brake cable securing and retaining feature.
Figure 20:
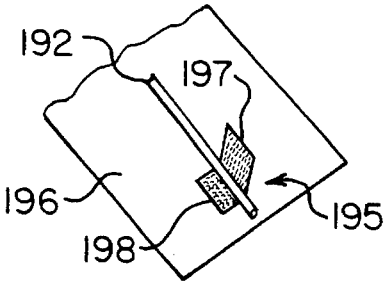
FIG. 20 shows the detail of the FIG. 19 brake cable securing device attached as part of the clothing worn by a skater.

FIGS. 19 and 20 illustrate yet another feature of the present invention. More particularly, retainer assembly 195 is configured with a flap 197 and base member 198 sewn, or otherwise attached, to the lower portion of knee length pants 196. Hook and loop or Velcro type material are included on the inner faces of flap 197 and 198 so as to secure cable 192 in a location intermediate of grip 186 and the skate. Typically, one of members 197 and 198 has the hook type surface while the other has the loop surface. Preferably, flap 197 is on the forward side of the skater to reduce the risk of dislodgement by impact from something while the skater is in motion. Connector 195 permits cable 192 to move upwards and downwards while securing it against outward flexing relative to the skater during normal movement of the skater.

Figure 21:
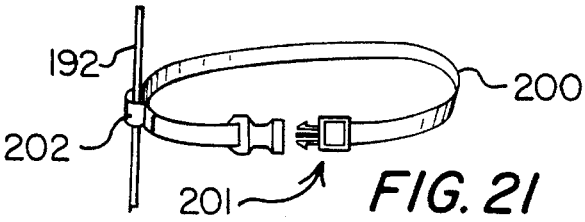
FIG. 21 is a thigh belt for securing the brake cable.

An alternative which avoids direct placement of the attachment on the clothing of the skater is to place a connector, like the Velcro material or the like, on the end of a belt like strip suitable for securing around the thigh of the skater. A further alternative on the thigh belt structure is shown in FIG. 21 wherein belt 200 is depicted with a bayonet type buckle 201, and a retainer loop 202 along the side for receiving cable 192. Note that retainer 202 could take a form similar to the Velcro type retainer 195 of FIGS. 19 and 20.

In use, the skater secures cable 192 at an intermediate point between the grip and the skate via a retainer on the clothing as in 195, or via a garter or thigh belt such as 200. Typically, this point is in proximity to the knee of the skater as illustrated in FIG. 19. This allows cable 192 to move up and down while retaining it close to the leg of the skater and preventing it from flopping sideways from the skater.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. In a roller skate having cable actuated brake elements cooperating with one or more wheels of said skate in response to movement of said brake elements in a predetermined direction by a cable having a first and a second end, said first end of said cable being connected to said brake elements, an apparatus for selectively locking said one or more skate wheels to accommodate walking on said skate, comprising;

a hand grip including a housing and a manually operable handle pivotally attached to said housing, said handle having a movable portion thereof connected to said second end of said cable, said handle normally assuming a position wherein said cable is not actuatinq said brake elements, said handle being manually rotatable into an actuated position operable to apply a force to said cable for moving said cable to a wheel locking position and said brake elements in said predetermined direction so as to prevent rolling of said one or more wheels having brake elements associated therewith, a shoulder formed in said handle, a manually rotatable thumb latch carried by said housing, and a spring attached to said housing and physically engaging said thumb latch to force bias said thumb latch in a direction away from said handle and to a thumb latch position wherein said handle is not locked in said actuated position, said shoulder and said thumb latch being brought into positional alignment when said handle is moved to said actuated position, whereupon said thumb latch may be selectively depressed against said force bias of said spring to a position whereat said thumb latch engages said shoulder and is operable to lock said handle in said actuated position when manual rotation of said handle is thereafter terminated, subsequent manual rotation of said handle from said actuated position being operable to automatically reset said thumb latch to said thumb latch position as a result of said force bias of said spring.

* * * * *